US006627829B2

(12) United States Patent
Sato

(10) Patent No.: US 6,627,829 B2
(45) Date of Patent: Sep. 30, 2003

(54) SWITCH DEVICE WITH INDICATOR

(75) Inventor: Dai Sato, Fussa (JP)

(73) Assignee: Teac Corporation, Tokyo (JP)

( * ) Notice: Subject to any disclaimer, the term of this patent is extended or adjusted under 35 U.S.C. 154(b) by 0 days.

(21) Appl. No.: 10/205,655

(22) Filed: Jul. 24, 2002

(65) Prior Publication Data

US 2003/0019733 A1 Jan. 30, 2003

(30) Foreign Application Priority Data

Jul. 25, 2001 (JP) ..... 2001-224018

(51) Int. Cl.[7] ..... H01H 9/16

(52) U.S. Cl. ..... 200/310; 200/5 R; 200/317; 362/28

(58) Field of Search ..... 200/5 R, 308, 200/310–317; 362/28–30

(56) References Cited

U.S. PATENT DOCUMENTS 5,464,955 A * 11/1995 Cole ..... 200/317
5,747,759 A * 5/1998 Lochmahr et al. ..... 200/5 R
5,861,589 A * 1/1999 Sato et al. ..... 200/5 R
6,155,691 A * 12/2000 Miyasaka ..... 362/30
6,207,913 B1 * 3/2001 Nakajima et al. ..... 200/314
6,479,769 B1 * 11/2002 Barat et al. ..... 200/5 R

* cited by examiner

*Primary Examiner*—Michael Friedhofer
(74) *Attorney, Agent, or Firm*—Christensen O'Connor Johnson Kindness PLLC

(57) ABSTRACT

A switch device with an indicator, in which the indication resolution for the operation amount of a switch can be increased without increasing the number of light emitting elements of the indicator and with a low cost, is provided. The switch device includes an LED which emits light when the operation state of a knob of the switch corresponds to a first state and an LED which emits light when the operation state of a knob of the switch corresponds to a second state. When the operation state of the knob lies between the first and second states, at least one of the amount and color of light emission from the LEDs is changed in order to indicate an intermediate operation state of the switch.

17 Claims, 7 Drawing Sheets

10
12
12a
12a1
12a2
12a3
12a4
12a5
12a6
12a7
12a8
12a9
12a10
12a11
10a
M
CONTROL SECTION

SWITCH DEVICE WITH INDICATOR

BACKGROUND OF THE INVENTION

1. Field of the Invention

The present invention relates to a switch device with an indicator, and more particularly to an improved switch device with an indicator capable of detailed indication of an operation amount of a switch.

2. Description of the Related Art

Switch devices are conventionally used for setting an amount of control for various devices. For example, rotary volume switches and sliding switches are widely used. FIG. 7 shows a mixer device 100 used for recording, which is one example of an operation panel in which a large number of such switch devices are arranged. In such a mixer device 100, because it is necessary to instantly visually recognize the operation amount (the amount or level to which a switch device has been operated, moved, or adjusted) of many switch devices, an indicator 102 capable of visually indicating noticeable change is often provided. In particular, for the mixer device 100 which is often used in a dimly-lighted room, a light emitting indicator 102 which allows quick judgment of the operation amount of the switch device is widely used because such an indicator is easier to recognize and costs less to manufacture than number display type switches, for example.

As an example, FIG. 8 illustrates a switch device including a rotary volume switch (hereinafter simply referred to as a "switch") 104 and a plurality of LEDs 102*a* arranged annularly around the switch to constitute an indicator 102. More specifically, FIG. 8 shows an example in which the position of lit LED 102*a* is sequentially moved in accordance with the operation amount of an operation knob (hereinafter simply referred to as a "knob") 104*a* of the switch 104. Increase in the operation amount results in increase in the number of lit LEDs. In the specific example shown in FIG. 8, the operation amount of the knob 104*a* is expressed by the lighting-up of LEDs up to the LED 102 at at the apex position.

Similar switch devices provided with such indicators are also used in, for example, an operation panel in an airplane cockpit, operation panels for various devices installed in a vehicle, and for electronic appliances. In any of these cases, it is necessary that the operation amount of the switch device can be visually recognized quickly and easily.

While mixer devices 100 shown in FIG. 7 come in a wide range of sizes, in all such devices the operation panel includes a great number of switches, such a as volume switches, sliding switches, push switches, and the like. In addition, various monitors and displays may also be disposed densely on the same single operation panel. Because the size of the various switches can only be reduced within a range where the operability of the switch is not impaired, the indicator 102 provided around the switch 104 is subjected to space limitation, as shown in FIG. 8. Similarly, the number of LEDs 102*a* constituting the indicator 102 is also limited. Typically, these LEDs 102 are disposed at intervals corresponding to units such as "each volume amount", "every even-numbered volume amount", "every fifth volume amount", or the like regarding the operation amount of the knob 104*a,* so that the operator can recognize the operation amount to be, for example, "volume 5" or "volume 6" in accordance with the number of the LEDs 102 which emit light. Accordingly, when the space for the indicator is limited, the sensitivity of the display of the indicator 102 must be reduced, which leads to a problem that the indication resolution of the operation amount is lowered. In particular, even though a volume switch, for example, is a switch which enables continuous adjustment of the operation amount of the switch, the indicator thereof can express the operation amount only intermittently when the number of states of the operation amount exceeds the number of LEDs 102 constituting the indicator 102. In this state, it cannot be said that the indicator 102 fully performs its intended function. While it is theoretically possible to provide a greater number of LEDs 102*a* to express a finer operation amount, such as every half unit, in fact it is not easy to increase the number of LEDs 102*a* because of the limitation space and cost limitations. Further, when the number of LEDs 102*a* are simply increased, it is necessary to set up an agreement regarding the indication patterns, for example, that two LEDs lighting up corresponds to "an operation amount of 1", and the amount of "0.5" or the like cannot be expressed adequately. This leads to increased risk of incorrect reading of the displayed information because of its increased complexity.

SUMMARY OF THE INVENTION

The present invention was conceived in view of the aforementioned problems of the related art and aims to provide a low cost switch device with an indicator which allows increased resolution of indication of an operation amount of a switch without increasing the number of light emitting elements of the indicator.

In order to achieve the above object, in accordance with one aspect of the present invention, there is provided a switch device with an indicator, said indicator indicating an operation amount of a switch by causing a light emitting element corresponding to an operation state of the switch to emit light, said switch device comprising an operation knob for operating the switch, and a control section for controlling light emission of said indicator in accordance with the operation amount of said operation knob, wherein said indicator includes a first light emitting element which emits light when the operation state of the switch is in a first state and a second light emitting element which emits light when the operation state of the switch is in a second state, and, when the operation amount of the operation knob lies between the first and second states, said control section changes at least one of the amount and color of light emission from either one of said first light emitting element and said second light emitting element to indicate an intermediate operation state of the switch.

Further, in order to achieve the above object, in accordance with another aspect of the present invention, there is provided switch device with an indicator, said indicator indicating an operation amount of a switch by causing a light emitting element corresponding to an operation state of the switch to emit light, said switch device comprising an operation knob for operating the switch, and a control section for controlling light emission of said indicator in accordance with the operation amount of said operation knob, wherein said indicator includes a first light emitting element which emits light when the operation state of the switch is in a first state and a second light emitting element which emits light when the operation state of the switch is in a second state, and, when the operation amount of the operation knob lies between the first and second states, said control section causes both the first and second light emitting elements to emit light to indicate an intermediate operation state of the switch.

With the above structure, in an indicator which can typically express the states only in two stages, a first state and second state, it is possible to express states at least in three stages. Further, when the amount or color of light emission from a light emitting element is changed in a multistage manner, further multistage expression can be achieved, so that the indication resolution can be increased easily.

In accordance with another preferred aspect of the present invention, the control section changes the amount or color of light emission in a multistage manner to indicate the intermediate operation state of the switch.

Further, in accordance with another preferred aspect of the present invention, the first light emitting element and the second light emitting element are disposed adjacent to each other.

Still further, in accordance with another preferred aspect of the present invention, the indicator includes an attention point provided for indicating a predetermined operation amount of the operation knob.

Moreover, in accordance with another preferred aspect of the present invention, when the operation amount of the operation knob passes the attention point, the control section makes the light emission pattern of the indicator before the attention point different from the light emission pattern of the indicator after the attention point.

Further, in accordance with another preferred aspect of the present invention, the control section controls lighting of the indicator on the right or left side of the attention point which serves as a base point, in accordance with the operation amount of the operation knob in the right or left direction.

Still further, in accordance with another preferred aspect of the present invention, the control section controls lighting of the indicator on the right and left sides of the attention point simultaneously, using the attention point as a base point, in accordance with the operation amount of the operation knob.

Further, in accordance with another preferred aspect of the present invention, the control section causes a plurality of successive light emitting elements to selectively light up in accordance with the operation amount of the operation knob, so that the lighting position of the indicator moves such that the lighting pattern of the indicator LEDs appears to move around the switch in a wave or pulse which appears to grow by extending and shrinking, similar to the movement of an inchworm as viewed from above.

With these configurations, in an indicator which is composed of the limited number of light emitting elements, further stages can be indicated to thereby increase the indication patterns and the indication resolution.

It should be noted that while the present invention will be understood more clearly with reference to the following description of a preferred embodiment, the scope of the present invention is not limited to the embodiment.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENT

A preferred embodiment of the present invention will be described with reference to the drawings.

Figures 1A, 1B, 1C, 1D, 1E, 1F, 1G, 1H:
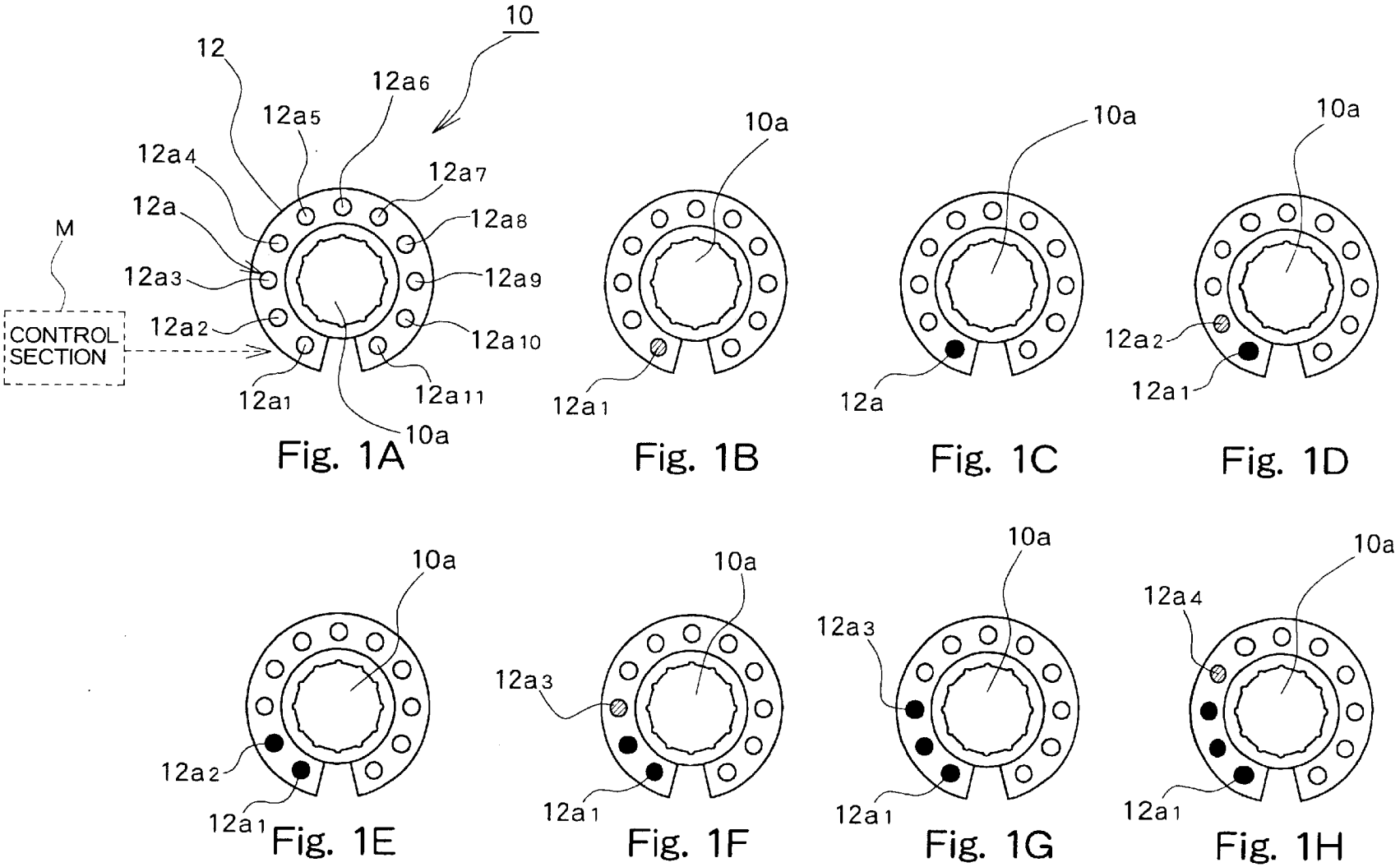
FIG. 1A is a diagram for explaining an example in which the amount of light emission from an LED is changed to increase the resolution of indication in a switch device with an indicator according to an embodiment of the present invention, and shows the indication state of the indicator in a certain operation state of the switch device.
FIG. 1B is a view showing the indication state of the indicator when the operation knob is turned clockwise by a predetermined amount from the state shown in FIG. 1A.
FIG. 1C is a view showing the indication state of the indicator when the operation knob is turned clockwise by a predetermined amount from the state shown in FIG. 1B.
FIG. 1D is a view showing the indication state of the indicator when the operation knob is turned clockwise by a predetermined amount from the state shown in FIG. 1C.
FIG. 1E is a view showing the indication state of the indicator when the operation knob is turned clockwise by a predetermined amount from the state shown in FIG. 1D.
FIG. 1F is a view showing the indication state of the indicator when the operation knob is turned clockwise by a predetermined amount from the state shown in FIG. 1E.
FIG. 1G is a view showing the indication state of the indicator when the operation knob is turned clockwise by a predetermined amount from the state shown in FIG. 1F.
FIG. 1H is a view showing the indication state of the indicator when the operation knob is turned clockwise by a predetermined amount from the state shown in FIG. 1G.
Figure 7:
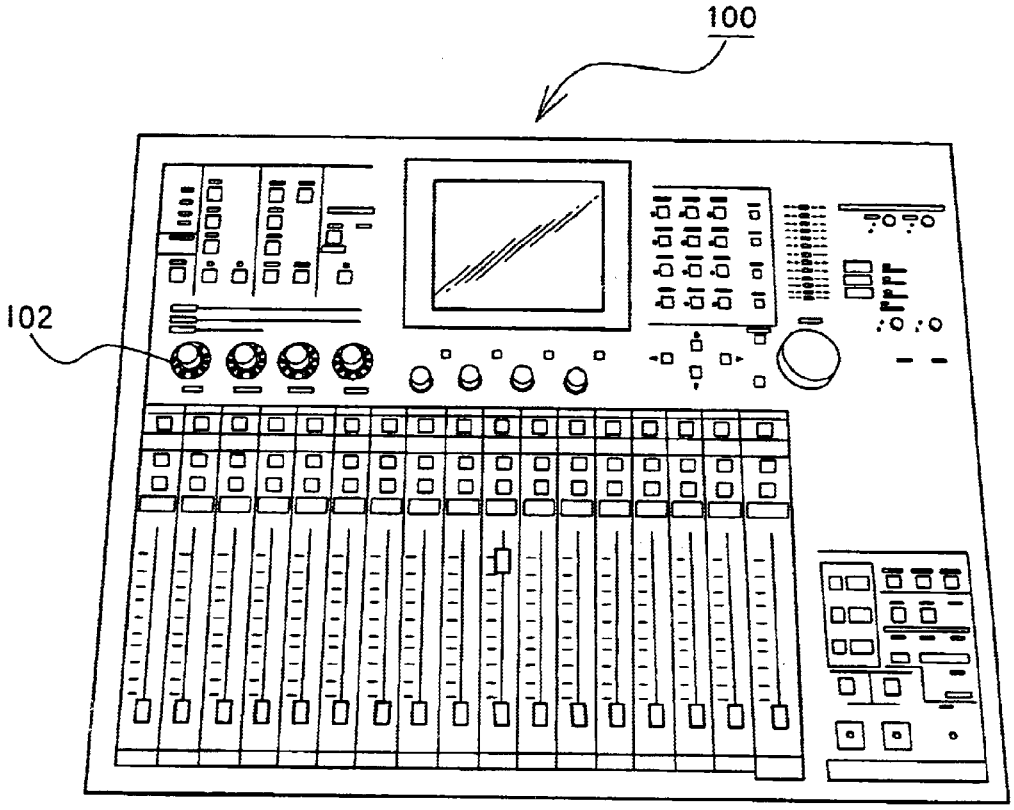
Fig. 7 (PRIOR ART)
FIG. 7 is a view for explaining the appearance of a mixer device.
Figure 8:
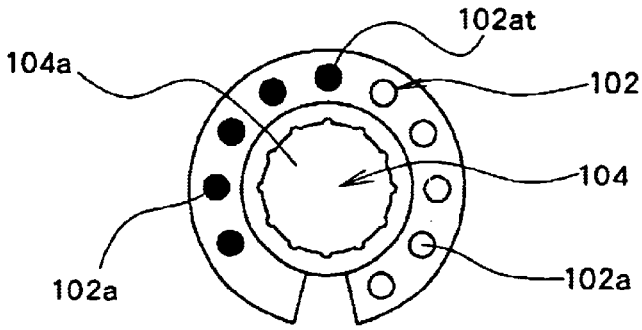
Fig. 8 (PRIOR ART)
FIG. 8 is a diagram for explaining a light emission pattern of a conventional switch with an indicator.

FIGS. 1A to 1H show change of the indication by an indicator 12 of a rotary volume switch (hereinafter simply referred to as a "switch") 10 according to the present embodiment disposed on the mixer device 100 (see FIG. 7). Here, the appearance of the switch 10 including the indicator 12 is the same as that shown in FIGS. 7, 8, and corresponding figures. An operation knob (hereinafter referred to simply as a "knob") 10*a* of the rotary switch 10 has a diameter of, for example, approximately 10 mm, and a height of approximately 20 mm. The indicator 12 is composed of a plurality of light emitting elements (for example, LEDs 12*a*) or the like disposed in a circle around the knob 10*a*. In the present embodiment, as shown in FIG. 1A, for example, the indicator 12 is composed of eleven LEDs 12*a*. Referring to FIGS. 1A to 1H, LED $\mathbf{12}a_1$ at the left end in the drawing indicates the minimum operation amount "volume 0" of the knob 10*a* and LED $\mathbf{12}a_{11}$ at the right end in the drawing indicates the maximum operation amount "volume 10" of the knob 10*a*. In accordance with the operation amount of the knob 10*a*, the position of the leading end of lit LEDs 12*a* sequentially moves in the order of LED $\mathbf{12}a_1$, $\mathbf{12}a_2$, $\mathbf{12}a_3$, $\mathbf{12}a_4$, . . . $\mathbf{12}a_{10}$, and $\mathbf{12}a_{11}$. Therefore, all the LEDs 12*a* including LED $\mathbf{12}a_1$ are lit when the operation amount corresponds to "volume 0", and all the LEDs 12*a* up to LED $\mathbf{12}a_{11}$ are lit when the operation amount corresponds to "volume 10". Then, in accordance with the increase or decrease of the operation amount of the knob 10*a*, the number of lit LEDs 12*a* also increases or decreases. For example, in order to indicate "volume 5", LEDs $\mathbf{12}a_1$ to $\mathbf{12}a_5$ light up. According to the present embodiment, lighting of the indicator 12 is controlled by a control section (lighting control circuit) M which includes a CPU for reading the operation amount of the switch 10, though the control section M is shown only in FIG. 1A.

The present embodiment is characterized as follows. Specifically, when the operation state of the switch lies between the first state and the second state, the amount or color of light emitted from either one of the first or second light emitting elements (LEDs) is changed to thereby indicate the intermediate operation state of the switch between the first and second operation amounts, whereby the resolution of indication by the indicator is increased. In another aspect, the present embodiment is characterized as follows. Specifically, when the operation state of the switch lies between the first and second states, both the first and second light emitting elements (LEDs) are caused to emit light to thereby indicate the intermediate operation state of the switch between the first and second operation amounts, whereby the resolution for indication by the indicator 12 is increased.

First, an example in which the amount of light emission from LED 12*a* is changed to increase the resolution will be described. It should be noted that, with regard to the operation state of the switch 10, the first state refers to, for example, the state corresponding to "volume 2" (as shown in FIG. 1E) and the second state refers to, for example, the state corresponding to "volume 3" (as shown in FIG. 1G). In both operation states, LED 12*a* is fully lit. Referring to FIGS. 1A to 1H, examples are shown in which the amount of light emission is decreased compared to the normal state to thereby indicate the intermediate operation state (such as the state corresponding to "volume 2.5). This partially or dimly lit state is herein referred to as DIM lighting. DIM lighting can be achieved by decreasing electric current flowing through the LED 12*a*. In the examples shown in FIGS. 1A to 1H, LED 12*a* which is not lit is indicated as ○, and LED 12*a* which is fully lit (maximum brightness) is indicated with ●. A dimly lit LED 12*a* is indicated using hatching.

In the state shown in FIG. 1A, none of the LEDs 12*a* are lit. In other words, FIG. 1A shows a state corresponding to "volume 0". FIG. 1B shows a state in which the knob 10*a* is turned slightly clockwise, and the control section M causes LED $\mathbf{12}a_1$ to light up dimly to indicate the state corresponding to "volume 0.5". When the knob 10*a* is further operated clockwise, the control section M causes LED 12*a*, to light up fully, as shown in FIG. 1C, to thereby indicate the state corresponding to "volume 1". In this manner, the control section M causes the state of the LEDs 12*a* to sequentially change to indicate the operation amount in the following order by the clockwise turning operation of the knob 10*a*: "volume 1.5" indicated by full lighting of LED 12*a*, and DIM lighting of LED $\mathbf{12}a_2$ (FIG. 1D); "volume 2" indicated by full lighting of LEDs $\mathbf{12}a_1$ and $\mathbf{12}a_2$ (FIG. 1E); "volume 2.5" indicated by full lighting of LEDs $\mathbf{12}a_1$ and $\mathbf{12}a_2$ and DIM lighting of LED $\mathbf{12}a_3$ (FIG. 1F); "volume 3" indicated by full lighting of LEDs $\mathbf{12}a_1$ to $\mathbf{12}a_3$ (FIG. 1G); and "volume 3.5" indicated by full lighting of LEDs $\mathbf{12}a_1$ to $\mathbf{12}a_3$ and DIM lighting of LED $\mathbf{12}a_4$ (FIG. 1H). It should be noted that, in FIG. 1H, the first state refers to the state in which LED $\mathbf{12}a_3$ lights up fully and the second state refers to the state in which the knob 10*a* is further operated clockwise and LED $\mathbf{12}a_4$ is fully lit. In the description made with reference to FIGS. 1A to 1H, it is assumed that when LED 12*a* indicates the first state, the LED 12*a* next to the LED 12*a* indicating the first state indicates the second state. Accordingly, FIG. 1H shows one example state which lies between the first and second states, namely one example of the intermediate operation states. When the knob 10*a* is operated counterclockwise, that is when the operation amount is decreased, it is also possible to indicate the intermediate operation state in the similar manner by using DIM lighting before lighting out of each LED 12*a*.

As described above, in order to indicate the intermediate operation state, the control section M can adjust the amount of light emission of LED 12*a* which is required for indicating the second state to cause the LED 12*a* to light up dimly, for example, so that the operation state of the knob 10*a* intermediate between two LEDs 12*a* can be expressed. Namely, it becomes possible to increase the resolution of indication of the indicator 12 without adding any additional LEDs 12*a* (without increasing the number of components). In the examples shown in FIGS. 1A to 1H, DIM lighting of LED 12*a* always precedes full lighting of the LED 12*a*, so that the operator can recognize the operation amount of the knob 10*a* from the number of LEDs 12*a* which light up fully and the existence of dimly lit LEDs. At this point, because it is not necessary to add a further LED 12*a* and increase the size of the switch 10, a conventional switch can be easily replaced with a switch according to the present invention and thereby increase the indication resolution of the indicator 12.

Figure 2:
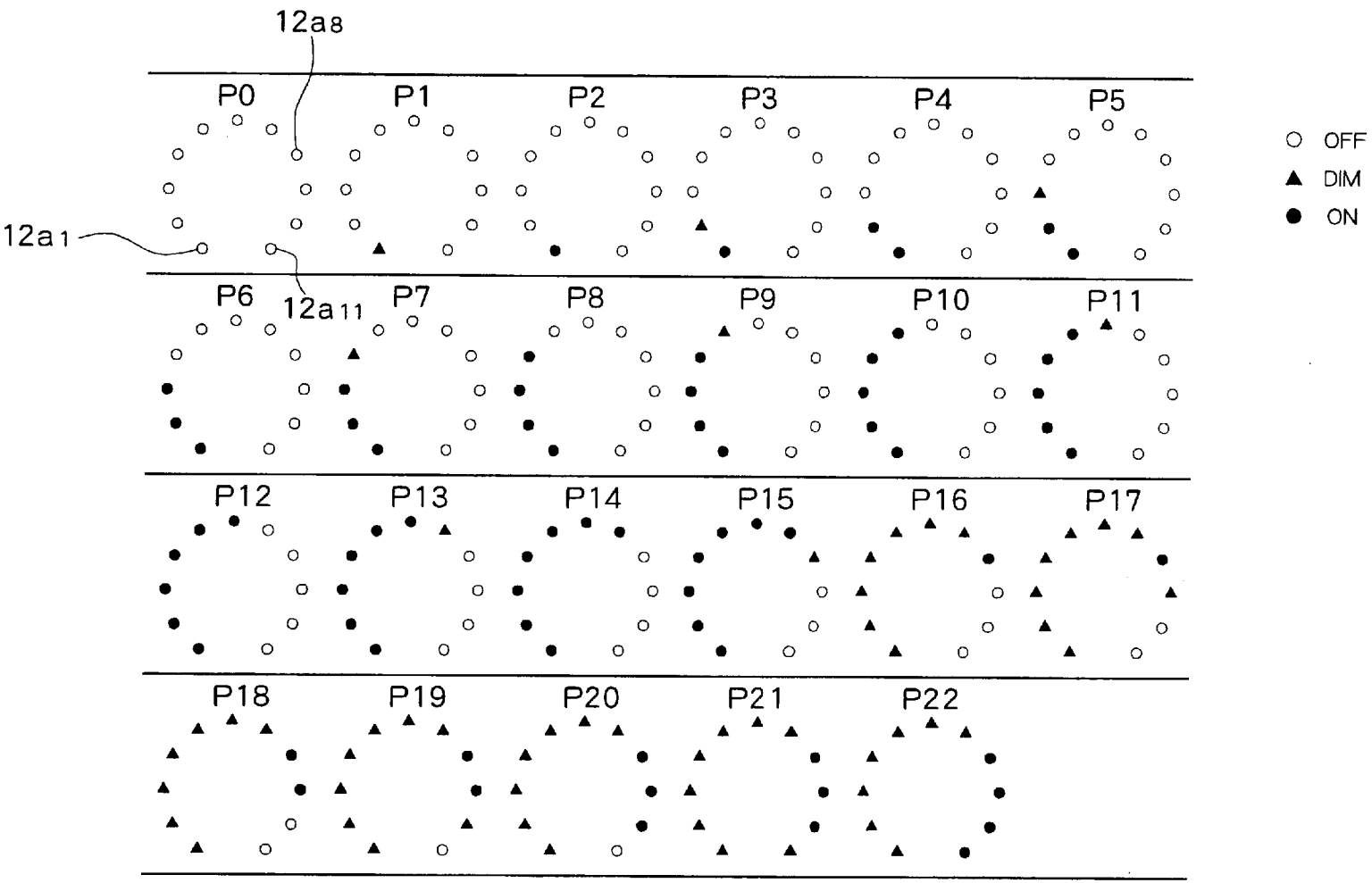
FIG. 2 is a diagram for explaining a modified example in which the amount of light emission from an LED is changed to increase the resolution of indication in a switch device with an indicator according to the embodiment of the present invention.

FIG. 2 schematically shows another light emission pattern of the indicator 12 in states P0 to P22. In the schematic drawings in FIG. 2 and later figures, a fully lit LED 12*a* is indicated with "●", an unlit LED 12*a* is indicated with "○", and a partially (dimly) lit LED 12*a* is indicated with ▲.

There are cases where an attention point indicative of the reference (neutral) point, a target point, a threshold value, or the like for the operation amount is provided in a switch 10 having an indicator 12. In the example shown in FIG. 2, the intermediate operation state between the first and second states is indicated using DIM lighting, and passage through the attention point is clearly expressed simultaneously. In FIG. 2, such an attention point is set at LED $\mathbf{12}a_8$ (volume 8), for example. First, before the attention point (the position of LED $\mathbf{12}a_8$) is reached, the control section M (see FIG. 1A) causes the indicator 12 to repeat indication by DIM lighting and full lighting as shown in FIGS. 1A to 1H, so as to achieve indication of the operation amount by "every 0.5 volume unit" (state P0 to state P15). Accordingly, an array of light emission of the indicator 12 which increases or decreases in accordance with the operation amount of the knob 10*a* is formed such that all the LEDs 12*a* through which the leading end of the array has passed light up fully until LED $\mathbf{12}a_8$ indicative of the attention point is reached. When the attention point is reached (state P16: volume 8), only LED $\mathbf{12}a_8$which is the attention point lights up fully, and all the LEDs $\mathbf{12}a_1$to $\mathbf{12}a_7$ which the leading end of the array has passed light up dimly. In this manner, by changing the state of light emission, easy recognition of passage through the attention point is made possible. With regard to LEDs 12$a_8$ to 12$a_{11}$ following the attention point, DIM lighting and full lighting are repeated in accordance with the operation amount of the knob 10*a,* to thereby increase the light emission array, as shown in FIGS. 1A to 1H. Of course, when the knob 10*a* is operated counterclockwise from the LED 12$a_{11}$ side, the light emission state of LED 12*a* is sequentially changed from state P22 to state P0.

By controlling the indicator 12 to display indications as described above, passage through the attention point can be clearly expressed simultaneously without increasing the number of LED 12*a* constituting the indicator 12, in addition to expression of the intermediate operation state.

Figure 3:
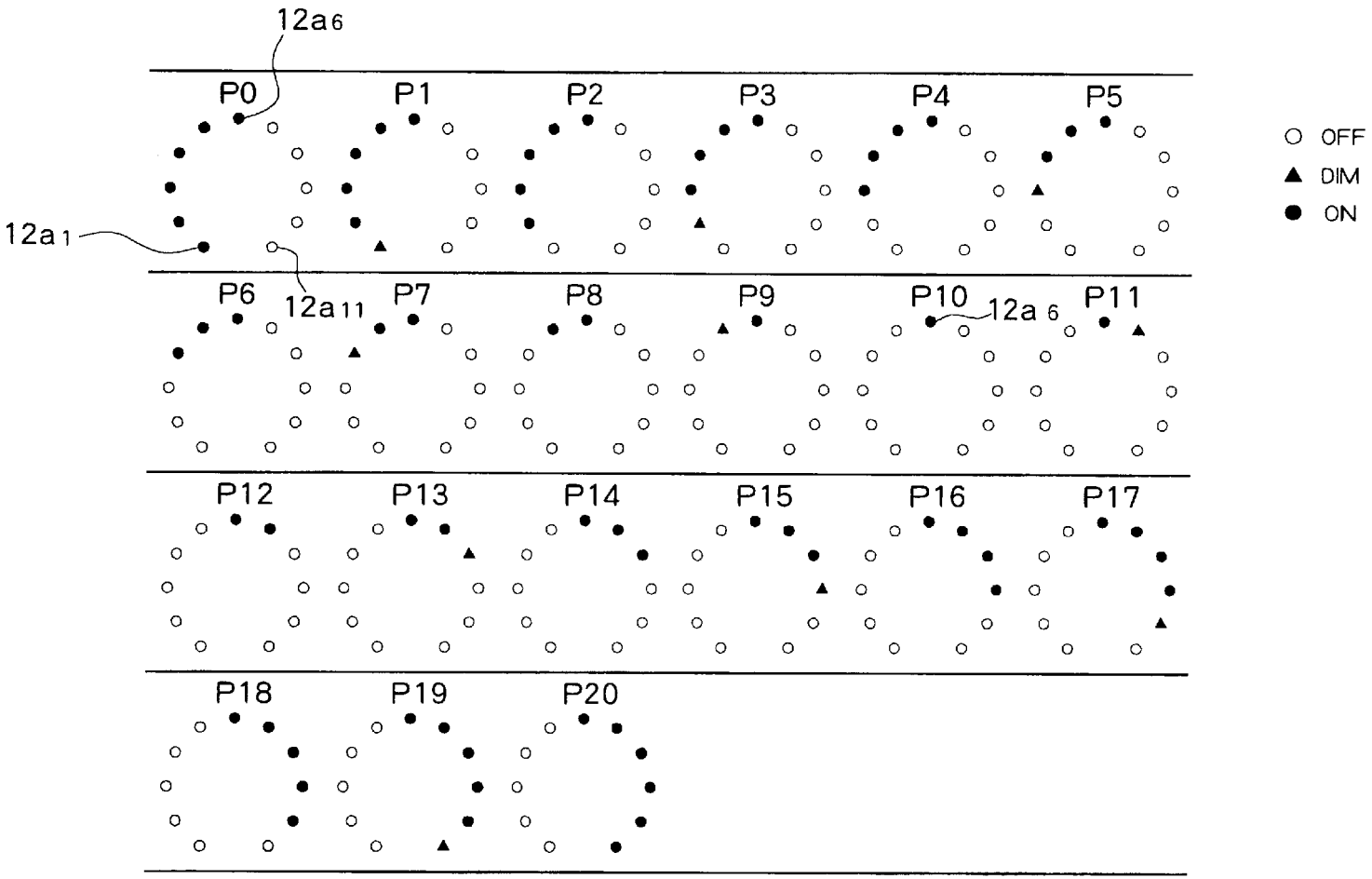
FIG. 3 is a diagram for explaining an example in which the amount of light emission from an LED is changed to increase the resolution of indication for L-R balancing in a switch device with an indicator according to the embodiment of the present invention.

Referring to FIG. 3, another light emission patterns of the indicator 12 in which DIM lighting is used to increase the indication resolution are shown. FIG. 3 illustrates an example in which a switch 10 is applied to left and right (L-R) volume balancing, for example. In this case, LED 12$a_6$ indicative of the attention point is a neutral point between L and R. As the knob 10*a* is turned counterclockwise, the control section M increases the array of lit LEDs 12*a* on the left side by sequentially repeating DIM and full lighting as shown in states P9 to P0, which indicates that volume is unbalanced and has deviation to left (L). As the knob 10*a* is turned clockwise, on the other hand, the control section M increases the array of light emitting LEDs 12*a* on the right side by sequentially repeating DIM and full lighting, as shown in states P11 to P20, which indicates that the volume is unbalanced and has deviation to the right (R).

In this manner, in a case where the indicator 12 is used to indicate L-R volume balance or the like, when the operation state of the knob 10*a* of the switch 10 lies between the first and second states, it is also possible to indicate the intermediate operation state of the switch 10 by changing the amount of light emission of either one of the first and second light emitting elements. Thus, the indication resolution can be increased two-fold.

Figure 4:
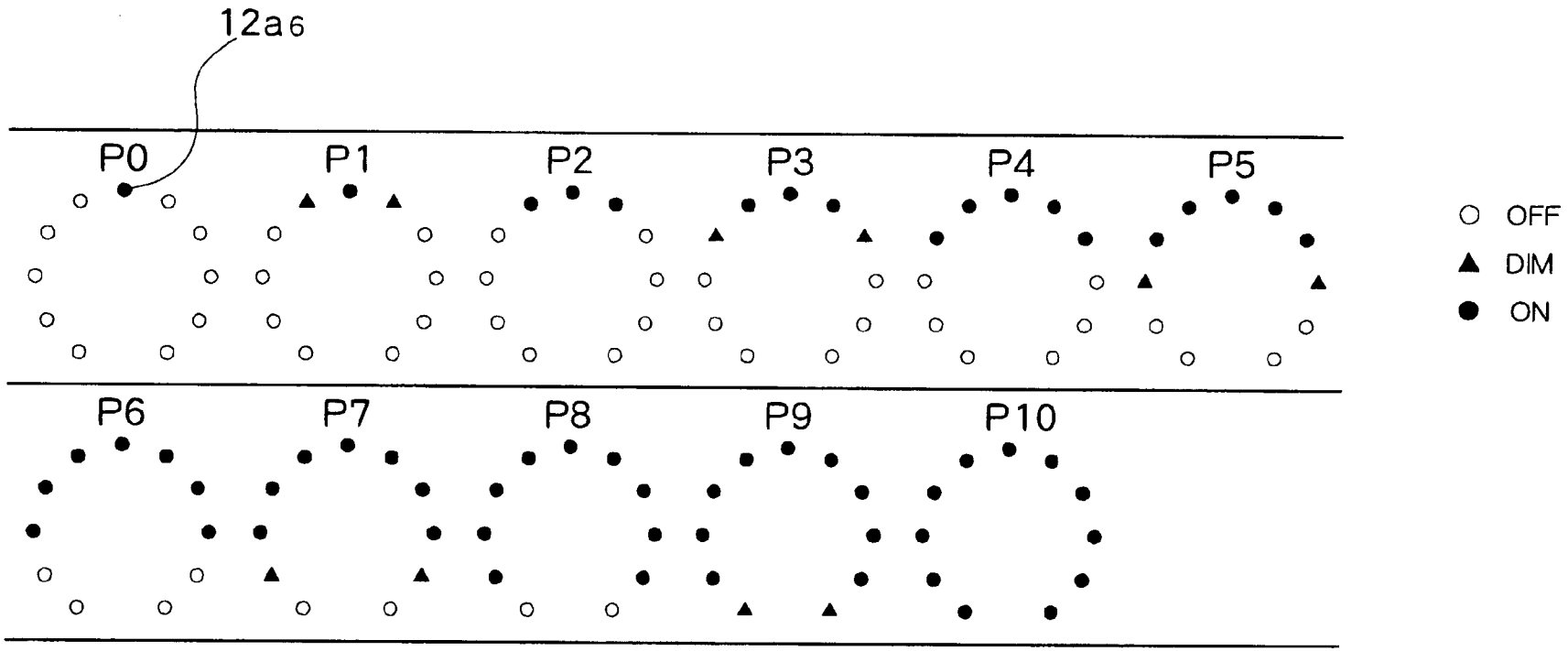
FIG. 4 is a diagram for explaining a modified example in which the amount of light emission from an LED is changed to increase the resolution of indication in a switch device with an indicator according to the embodiment of the present invention.

Referring to FIG. 4, still other light emission patterns of the indicator 12 in which DIM lighting is used to increase the indication resolution are shown. In the example of FIG. 4, the arrays of light emission of the indicator 12 are simultaneously increased or decreased on both the right and left sides of the LED 12$a_6$, which is located at the center of the indicator 12 and which serves as a reference (base point). In this case, it is also possible to double the indication resolution in a simple manner using DIM lighting.

In the examples shown in FIGS. 1A to 1H, FIG. 2 to FIG. 4, single-stage DIM lighting (which is approximately one half luminance of full lighting) is used, so that the indication resolution can be doubled. Alternatively, it is possible perform DIM lighting in multiple stages (such as ¼ lighting, ⅔ lighting, and ¾ lighting, or any appropriate sequence), so that the indication resolution can be further increased.

Further, each LED 12*a* in FIGS. 1A to 1H and FIGS. 2 to 4 may be formed by a multicolor light emitting type LED, such as an LED unit having light emitting elements of a plurality of colors. For example, when a single LED 12*a* is composed of a red light emitting element and a green light emitting element, the intermediate operation state can be expressed by one or two colors. More specifically, after the first state is expressed by emitting red light from LED 12*a,* the LED 12*a* can then emit green light or orange light obtained by combination of red and green light so as to express the intermediate operation state. Consequently, the indication resolution can be increased in the same manner as in the examples of FIGS. 1A to 1H and FIGS. 2 to 4, by changing the color of light emission instead of amount of light emission. Further, it is also possible to increase the indication resolution in a similar manner by using a color filter to change the color of light emission.

Of course, a combination of change in the amount of light emission and the change in the color of light emission enables a further variation, which increases the indication resolution.

Figure 5:
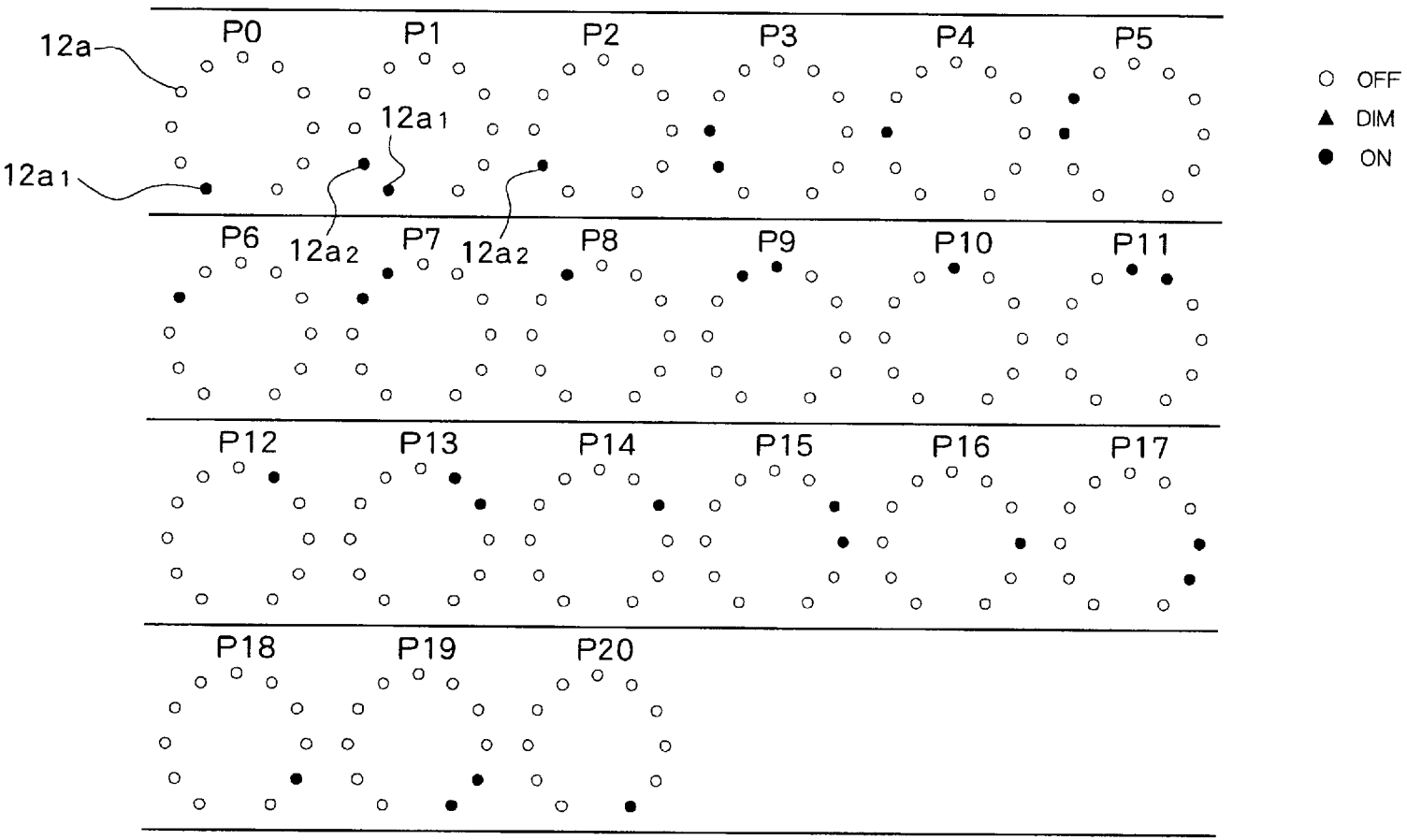
FIG. 5 is a diagram for explaining another light emission pattern for increasing the resolution of indication in a switch device with an indicator according to the embodiment of the present invention.

Referring to FIG. 5, still other light emission patterns in which the indication resolution is increased are shown. Specifically, in the light emission pattern shown in FIG. 5, lighting of a single LED and lighting of two LEDs is repeated for each pair of two LEDs 12*a,* so that the indication position is moved in the "inchworm" manner explained above, thereby achieving three patterns of indication using each pair of two LEDs 12*a*. It should be noted that in the example of FIG. 5, the state P0 in which LED 12*a,* lights up indicates "volume 0". For example, the state in which LED 12$a_1$ lights up as shown in the state P0 corresponds to the first state which indicates "volume 0", and the state in which LED 12$a_2$lights up as shown in the state P2 corresponds to the second state which indicates "volume 1". In this case, the state in which both LED 12$a_1$and LED 12$a_2$ are lit as shown in state P1 is the intermediate operation state of the knob 10*a,* which indicates "volume 0.5". In other words, by changing the number of lit LEDs 12*a* in a pattern of 1, 2, 1, 2, 1, . . . , the indicator can express half units of the operation amount. Subsequently, by repeating lighting of one LED 12*a* and lighting of two LEDs 12*a* in the similar manner, the control section M (see FIG. 1A) can allow, for example, 21 stages of indication using 11 LEDs 12*a,* as shown in FIG. 5, whereby the indication resolution can be increased. Current control or the like required for the examples of FIGS. 1A to 1H is not necessary in order to perform light emission control as shown in FIG. 5, and only ON/OFF control of the LEDs 12*a* is required. Indication resolution can therefore be increased by simple control.

Figure 6:
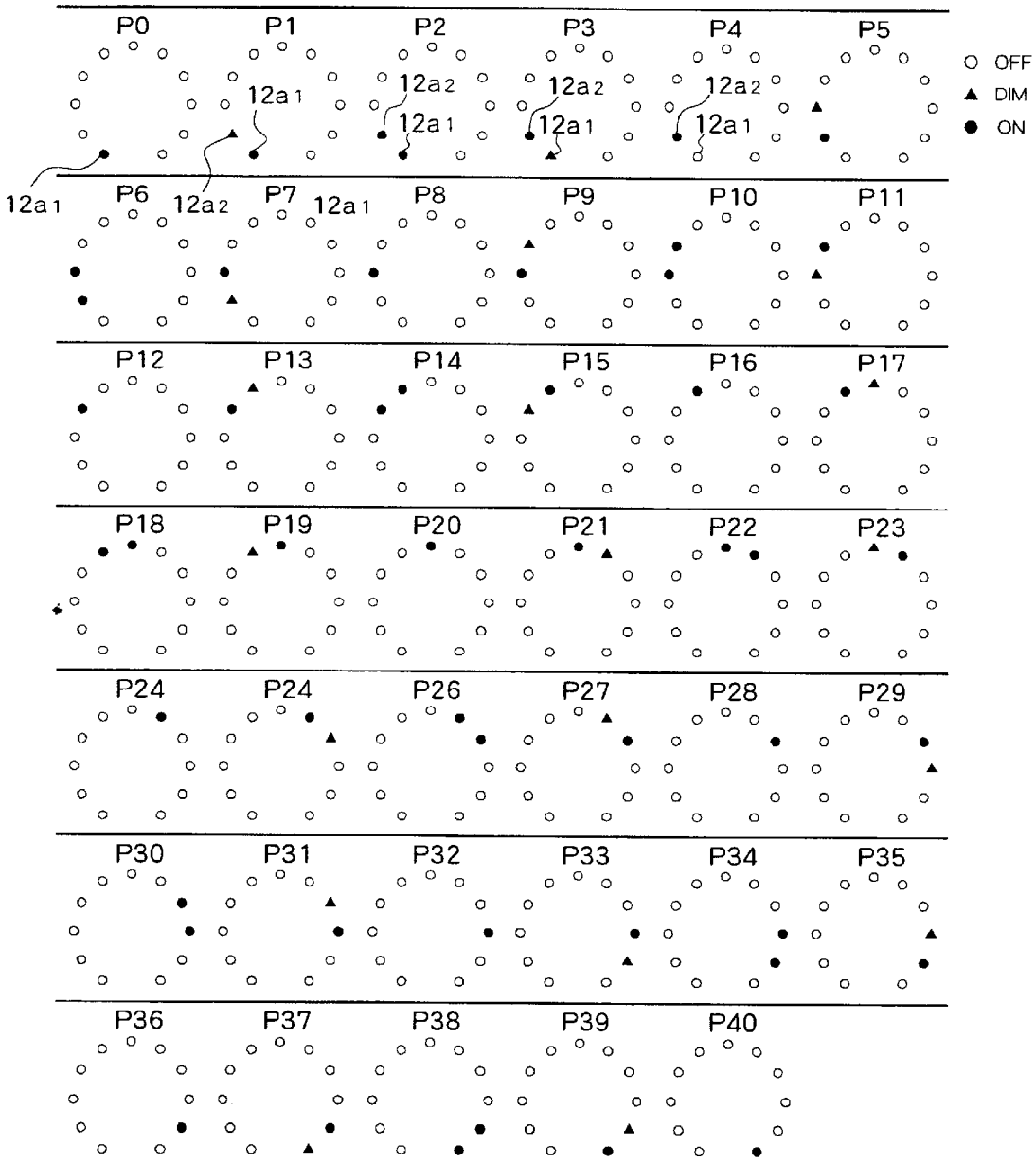
FIG. 6 is a diagram for explaining a light emission pattern using DIM lighting for further increasing the resolution of indication.

Referring to FIG. 6, a further light emission pattern, which is an application of the display pattern of FIG. 5 and further increases the indication resolution, is shown. More specifically, in the example shown in FIG. 6, in addition to the method of FIG. 5 in which lighting of a single LED and lighting of two LEDs is repeated for each pair of two LEDs 12*a,* so that indication position is moved in the "inchworm" manner explained above, the control section M further controls DIM lighting. In FIG. 6, as in the example of FIG. 5, state P0 in which LED 12*a,* lights up indicates "volume 0". For example, the state in which LED 12*a* lights up as shown in the state P0 corresponds to the first state which indicates "volume 0", and the state in which LED 12$a_2$lights up as shown in the state P4 corresponds to the second state which indicates "volume 1". In the example of FIG. 6, the intermediate operation state between "volume 0" indicated by lighting state of LED 12*a,* and "volume 1" indicated by lighting state of LED 12$a_2$ is divided into four states using DIM lighting. Specifically, full lighting of LED 12$a_1$ and DIM lighting of LED 12$a_2$ in state P1 indicates "volume 0.25". Further, full lighting of both LED 12*a,* and LED 12$a_2$ in state P2 indicates "volume 0.5". Still further, DIM lighting of LED 12*a,* and full lighting of LED 12$a_2$ in state P3 indicates "volume 0.75". In other words, by changing the number of lit LEDs 12*a* in a pattern of 1, 2, 1, 2, 1 . . . while repeating full lighting and DIM lighting of LED 12*a,* the indicator can express "every 0.25 amount of volume" of the operation amount. Subsequently, by repeating lighting of one LED 12*a* and lighting of two LEDs 12*a* while performing full and DIM lighting of LEDs 12*a* in the similar manner, the control section M can enable, for example, 41 stages of indication using 11 LEDs 12*a,* and thereby increase the indication resolution of the array. In the example of FIG. 6, it is also possible to change the color of light emission instead of amount of light emission, of the LEDs 12*a,* to thereby similarly increase the indication resolution. Of course, the indicator can perform further detailed expression by changing the amount or color of light emission in further multistage manner or combining the change of the amount of light emission and the change of the color of light emission. Further, the inchworm movement shown in FIGS. 5 and 6 can also be achieved by using a pair three or more LEDs 12*a,* for example. Although this has an advantage of further increase in the indication patterns, the number of LEDs 12*a* to be used must be selected appropriately as it is undesirable that discrimination of the indicated volume value be made complicated or difficult.

Further, by applying the above-described "looping motion" indication method to the indication methods shown in FIGS. 2, 3, 4 or the like, the variation of the indication patterns of FIGS. 2, 3, 4 or the like can be further increased. As a result, the indication resolution of the indicator can be increased easily.

Although an example in which a switch 10 is applied to a mixer device 100 is described in the above embodiment, the present invention is also applicable to any other devices as long as a switch having an indicator is used, and can be applied, for example, to an operation panel in an airplane cockpit, in a motor vehicle, or in electrical appliances where detailed indication of the indicator is required in the situation where the number of light emitting elements which can be used is limited, and the similar effects can be obtained. Further, although the indicator is disposed annularly around the volume switch in the present embodiment, similar effect can be obtained when a linear indicator is disposed in the vicinity of the volume switch. Further, a switch is not limited to a volume type switch, and other switches including a sliding switch or a switch which is pushed several times to increase the operation amount may be similarly applicable, as long as a switch is provided with an indicator, and similar effects can be achieved. In addition, while the intermediate operation state was described in units of one half, one quarter, or the like, indication of the intermediate operation state is arbitrary and any other type of indication may be employed as long as an intermediate value between the first and second states can be indicated.

While the preferred embodiment of the present invention has been described using specific terms, such description is for illustrative purposes only, and it is to be understood that changes and variations may be made without departing from the spirit or scope of the appended claims.

What is claimed is:

1. A switch device with an indicator, said indicator indicating an operation amount of a switch by causing a light emitting element corresponding to an operation state of the switch to emit light, said switch device comprising:

an operation knob for operating the switch; and a control section for controlling light emission of said indicator in accordance with the operation amount of said operation knob, wherein said indicator includes a first light emitting element which emits light when the operation state of the switch is in a first state and a second light emitting element which emits light when the operation state of the switch is in a second state, and when the operation amount of the operation knob lies between the first and second states, said control section changes at least one of the amount and color of light emission from either one of said first light emitting element and said second light emitting element to indicate an intermediate operation state of the switch.

2. A switch device with an indicator according to claim 1, wherein said control section changes the amount or color of light emission in a multistage manner to indicate the intermediate operation state of the switch.

3. A switch device with an indicator according to claim 1, wherein said first light emitting element and said second light emitting element are disposed adjacent to each other.

4. A switch device with an indicator according to claim 1, wherein said indicator includes an attention point provided for indicating a predetermined operation amount of the operation knob.

5. A switch device with an indicator according to claim 4, wherein when the operation amount of the operation knob passes the attention point, said control section makes the light emission pattern of the indicator before the attention point different from the light emission pattern of the indicator after the attention point.

6. A switch device with an indicator according to claim 4, wherein said control section controls lighting of the indicator on the right or left side of the attention point which serves as a base point, in accordance with the operation amount of the operation knob in the right or left direction.

7. A switch device with an indicator according to claim 4, wherein said control section controls lighting of the indicator on the right and left sides of the attention point simultaneously, using the attention point as a base point, in accordance with the operation amount of the operation knob.

8. A switch device with an indicator according to claim 1, wherein said control section causes a plurality of successive light emitting elements to selectively light up in accordance with the operation amount of the operation knob, so that the lighting pattern of the indicator mimics the appearance of an inchworm in motion.

9. A switch device with an indicator, said indicator indicating an operation amount of a switch by causing a light emitting element corresponding to an operation state of the switch to emit light, said switch device comprising:

an operation knob for operating the switch; and a control section for controlling light emission of said indicator in accordance with the operation amount of said operation knob, wherein said indicator includes a first light emitting element which emits light when the operation state of the switch is in a first state and a second light emitting element which emits light when the operation state of the switch is in a second state, and when the operation amount of the operation knob lies between the first and second states, said control section causes both the first and second light emitting elements to emit light to indicate an intermediate operation state of the switch.

10. A switch device with an indicator according to claim 9, wherein when the operation amount of the operation knob lies between the first and second states, said control section changes at least one of the amount and color of light emission from either one of said first light emitting element and said second light emitting element to indicate the intermediate operation state of the switch.

11. A switch device with an indicator according to claim 10, wherein said control section changes the amount or color of light emission in a multistage manner to indicate the intermediate operation state of the switch.

12. A switch device with an indicator according to claim 9, wherein said first light emitting element and said second light emitting element are disposed adjacent to each other.

13. A switch device with an indicator according to claim 9, wherein said indicator includes an attention point provided for indicating a predetermined operation amount of the operation knob.

14. A switch device with an indicator according to claim 9, wherein when the operation amount of the operation knob passes the attention point, said control section makes the light emission pattern of the indicator before the attention point different from the light emission pattern of the indicator after the attention point.

15. A switch device with an indicator according to claim 9, wherein said control section controls lighting of the indicator on the right or left side of the attention point which serves as a base point, in accordance with the operation amount of the operation knob in the right or left direction.

16. A switch device with an indicator according to claim 9, wherein said control section controls lighting of the indicator on the right and left sides of the attention point simultaneously, using the attention point as a base point, in accordance with the operation amount of the operation knob.

17. A switch device with an indicator according to claim 9, wherein said control section causes a plurality of successive light emitting elements to selectively light up in accordance with the operation amount of the operation knob, so that the lighting pattern of the indicator mimics the appearance of an inchworm in motion.

* * * * *